US005335801A

United States Patent [19]

Lee

[11] Patent Number: 5,335,801

[45] Date of Patent: Aug. 9, 1994

[54] STOPPER SEALING CAP FOR INJECTABLE FLUID BOTTLE

[76] Inventor: Yong-Hak Lee, 377-48, Shindang-2-dong Chung-ku, Seoul, Rep. of Korea

[21] Appl. No.: 101,068

[22] Filed: Aug. 3, 1993

[30] Foreign Application Priority Data

Aug. 13, 1992 [KR] Rep. of Korea ..... 15209/92

[51] Int. Cl.[5] ..... B65D 51/18

[52] U.S. Cl. ..... 215/249; 215/251; 215/355; 215/307; 220/257; 220/366

[58] Field of Search ..... 215/204, 247, 248, 249, 215/251, 258, 307, 355, DIG. 3, 309; 220/256, 257, 268, 269, 271, 276, 366, 367, 373

[56] References Cited

U.S. PATENT DOCUMENTS

| | | | |
|---|---|---|---|
| 3,071,274 | 1/1963 | Raun | 215/249 |
| 3,193,128 | 7/1965 | Raun | 215/249 X |
| 3,587,897 | 6/1971 | Rohde | 215/249 |
| 4,205,754 | 6/1980 | Nielsen et al. | 215/249 |
| 4,382,521 | 5/1983 | Ostrowsky | 215/307 |
| 4,471,879 | 9/1984 | Connor et al. | 215/249 |
| 4,635,807 | 1/1987 | Knapp . | |
| 4,664,279 | 5/1987 | Orbrist et al. . | |
| 4,668,458 | 5/1987 | Whitney . | |
| 4,738,370 | 4/1988 | Urmston et al. | 215/307 |
| 4,754,889 | 7/1988 | Debetencourt . | |
| 4,760,935 | 8/1988 | van den Beld et al. . | |
| 4,770,309 | 9/1988 | Thompson . | |
| 4,801,033 | 1/1989 | Kanner . | |
| 4,801,040 | 1/1989 | Kraus . | |
| 4,811,855 | 3/1989 | Bergström et al. . | |
| 4,815,783 | 3/1989 | Montreuil et al. . | |
| 4,863,030 | 9/1989 | Bayer et al. . | |
| 5,080,245 | 1/1992 | Conard | 215/249 |
| 5,152,413 | 10/1992 | Conrad | 215/249 |

*Primary Examiner*—Allan N. Shoap
*Assistant Examiner*—Stephen Cronin

[57] ABSTRACT

A stopper sealing for an injectable fluid bottle suitable for protection of an upper surface of a rubber stopper of the bottle from contamination. The sealing cap comprises a sealing member for sealing the upper surface of the rubber stopper to prevent contaminant infiltration onto the upper surface of the stopper, an aluminum cap member engaging with the sealing member and covering the uppermost part of the bottle, and a synthetic resin cap member covering the aluminum cap member and engaging with the sealing member. The aluminum cap member has a center opening for receiving the sealing member and remains on the upper section of the bottle when the sealing member is removed from the bottle. The resin cap member is removed together with the sealing member from the bottle and has a center opening for receiving the sealing member, and a plurality of vertical slots; on its side inner surface for providing spaces between it and the aluminum cap member.

3 Claims, 5 Drawing Sheets

STOPPER SEALING CAP FOR INJECTABLE FLUID BOTTLE

BACKGROUND OF THE INVENTION

1. Field of the Invention

The present invention relates in general to stoppers for containers of injectable fluids, and more particularly to a sealing cap for the stopper suitable for hygienic protection of an upper surface of rubber stopper of the bottle from infiltration of contaminants, 2. Description of the Prior Art U.S. Pat. No. 4,635,807 disclosed a stopper for a bottle of an injectable fluid which comprises a rubber stopper which is tightly placed in the neck of the injectable fluid bottle and is covered with a sealing cap. This sealing cap comprises an aluminum cap member which covers the rubber stopper and is, in turn, covered with a synthetic resin cap member. Here, the synthetic resin cap member simply covers the aluminum cap member, so that foreign substances or contaminants, such as water, dust and bacteria, can easily infiltrate between the synthetic resin cap member and the aluminum cap member during custody of the injectable fluid bottle to contaminate the upper surface of the rubber stopper. Moreover, these contaminants are not completely eliminated from the upper surface of the rubber stopper even when the upper surface of the rubber stopper is subjected to disinfection using an alcoholic cotton after removal of the sealing cap in order to use the injectable fluid of tho bottle. In order to use the injectable fluid of the bottle, a needle of a syringe or of ringer's set penetrates the rubber stopper of the bottle still contaminated with the contaminants. Thus, the disadvantage of the known sealing cap lies in the fact that the contaminants on the upper surface or the rubber stopper may infiltrate into the human body through the needle.

SUMMARY OF THE INVENTION

It is, therefore, an object of the present invention to provide a stopper sealing cap for an injectable fluid bottle which overcomes the aforementioned problem by hygienically protecting the upper surface of a rubber stopper placed in the neck of the injectable fluid bottle from contamination.

It is another object of the present invention to provide a stopper sealing cap for an injectable fluid bottle of which the structure facilitates disinfection of the rubber stopper of the injectable fluid bottle and achieves a convenient use of the injectable fluid bottle.

To accomplish the above objects, a stopper sealing cap for an injectable fluid bottle in accordance with an embodiment of the present invention comprises a sealing member for sealing an upper surface of a rubber stopper or the bottle to prevent contaminant infiltration onto the upper surface of the stopper, the sealing member having an annular protrusion for annularly cutting into the upper surface of the stopper of the bottle to seal the upper surface from the outside, and an aluminum cap member engaging with the sealing member and covering the uppermost part of the battle, the aluminum cap member having a top center opening for receiving the sealing member and remaining on the upper section of the bottle when the sealing member is removed from the bottle; and a synthetic resin cap member covering the aluminum cap member, the resin cap member being removed together with the sealing ember from the bottle and having a plurality of vertical slots on an inner surface of its side wall for providing spaces between the side wall and the aluminum cap member.

In accordance with the sealing cap of this invention, the upper surface of the rubber stopper is prevented from contamination and maintains its sterilized state until the sealing cap is removed from the bottle. When the synthetic resin cap member is levered in order to remove the sealing cap from the bottle, the sealing member is removed from the bottle to expose the upper surface of the rubber stopper. This exposed rubber stopper is disinfected using an alcoholic cotton prior to needle penetration, thereby allowing no contaminant to infiltrate into the human body through the needle.

BRIEF DESCRIPTION OF THE DRAWINGS

The above and other objects, features end other advantages of the present invention will be more clearly understood from the following detailed description taken in conjunction with the accompanying drawings, in which.

DESCRIPTION OF THE PREFERRED EMBODIMENTS

Figure 1:
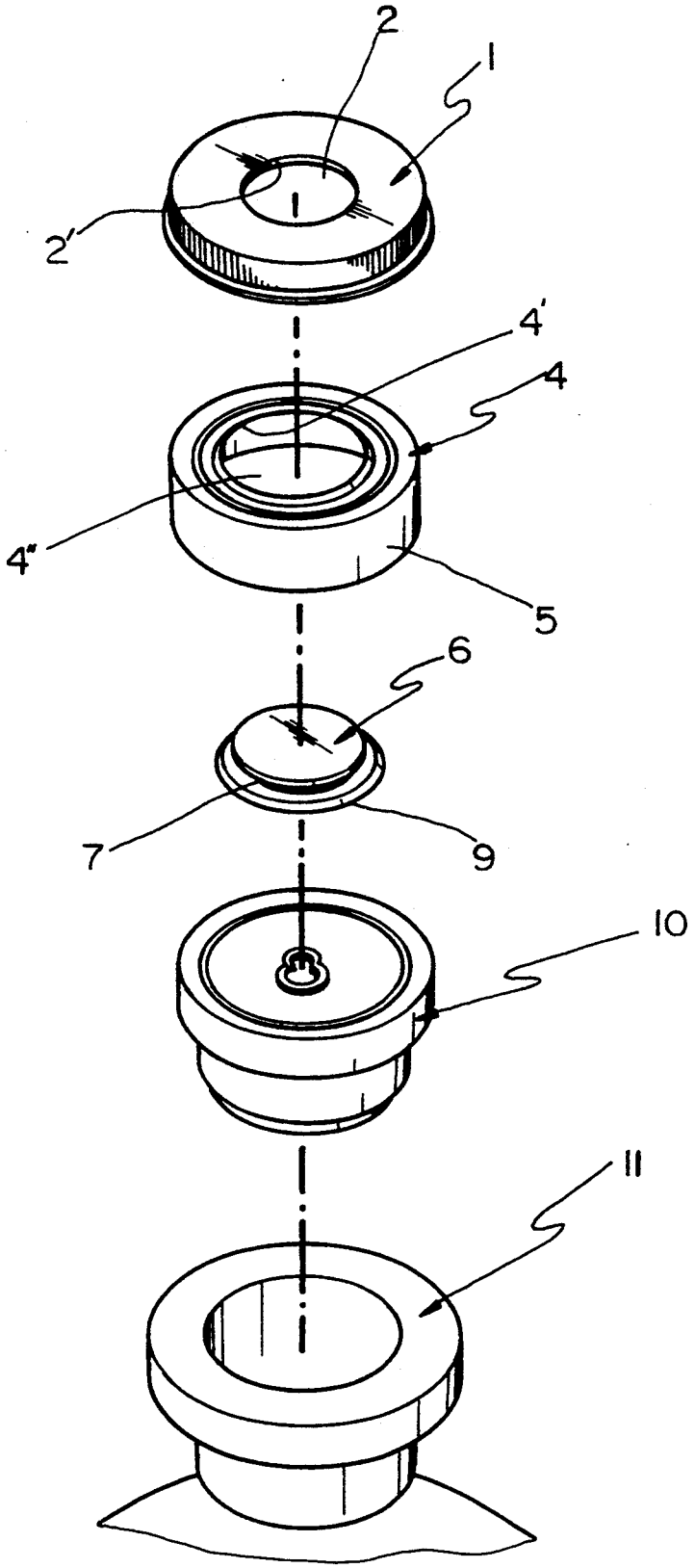
FIG. 1 is an exploded perspective view of a stopper sealing cap for an injectable fluid bottle in accordance with an embodiment of the present invention.
Figure 2A:
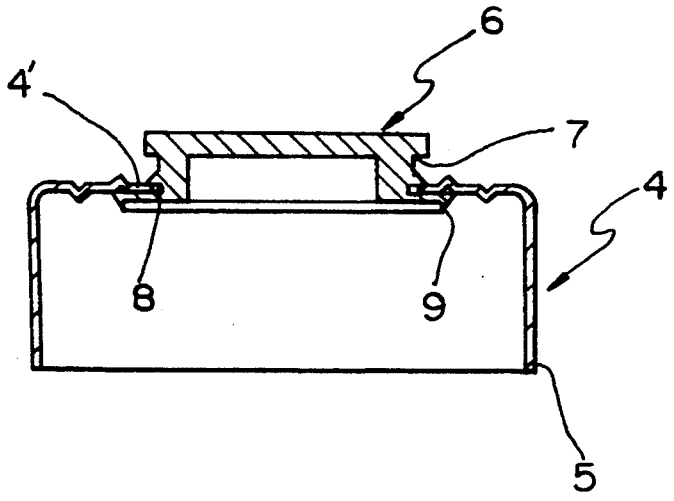
FIG. 2A is a sectional view of a pre-assembly of the sealing cap of the present invention wherein a sealing member engages with an aluminum cap member.
Figure 2B:
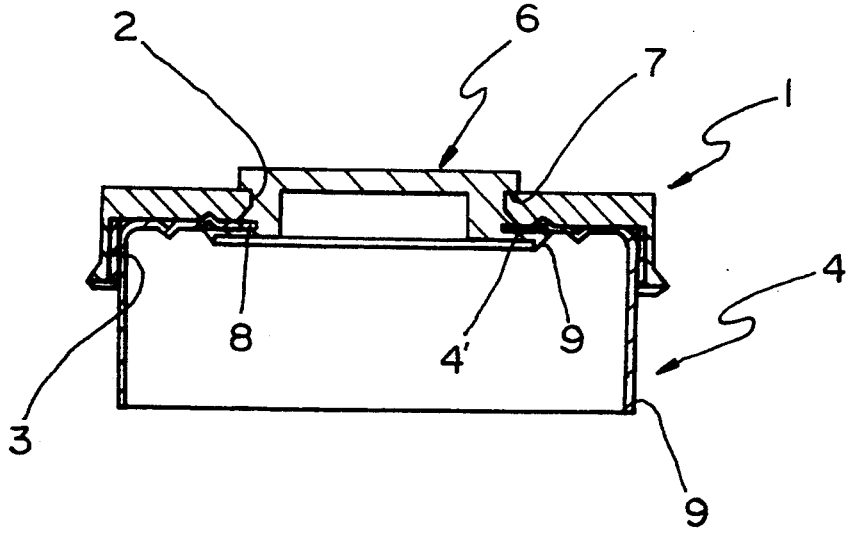
FIG. 2B is a sectional view of a result assembly of the sealing cap of the present invention wherein the pre-assembly of FIG. 2A engages with a synthetic resin cap member.
Figure 2C:
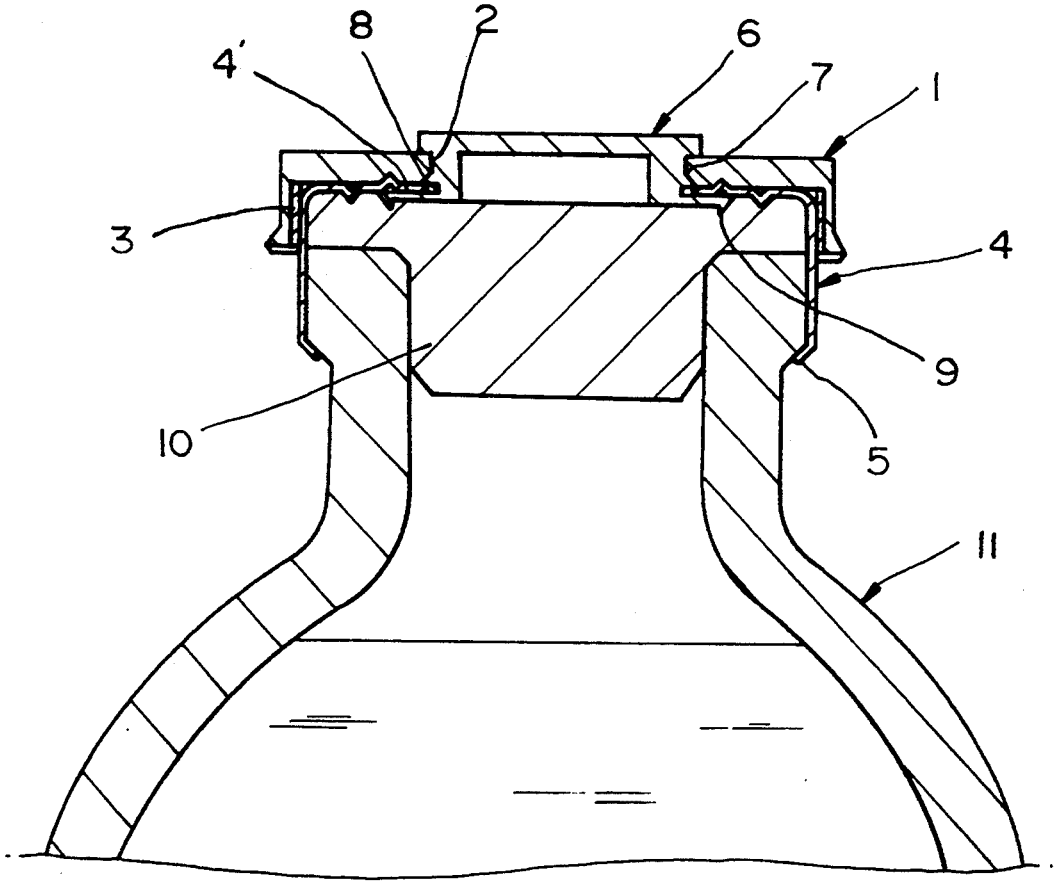
FIG. 2C is a sectional view of the result assembly of FIG. 2B combined with an injectable fluid bottle of which the neck is blocked with a rubber stopper.
Figure 3:
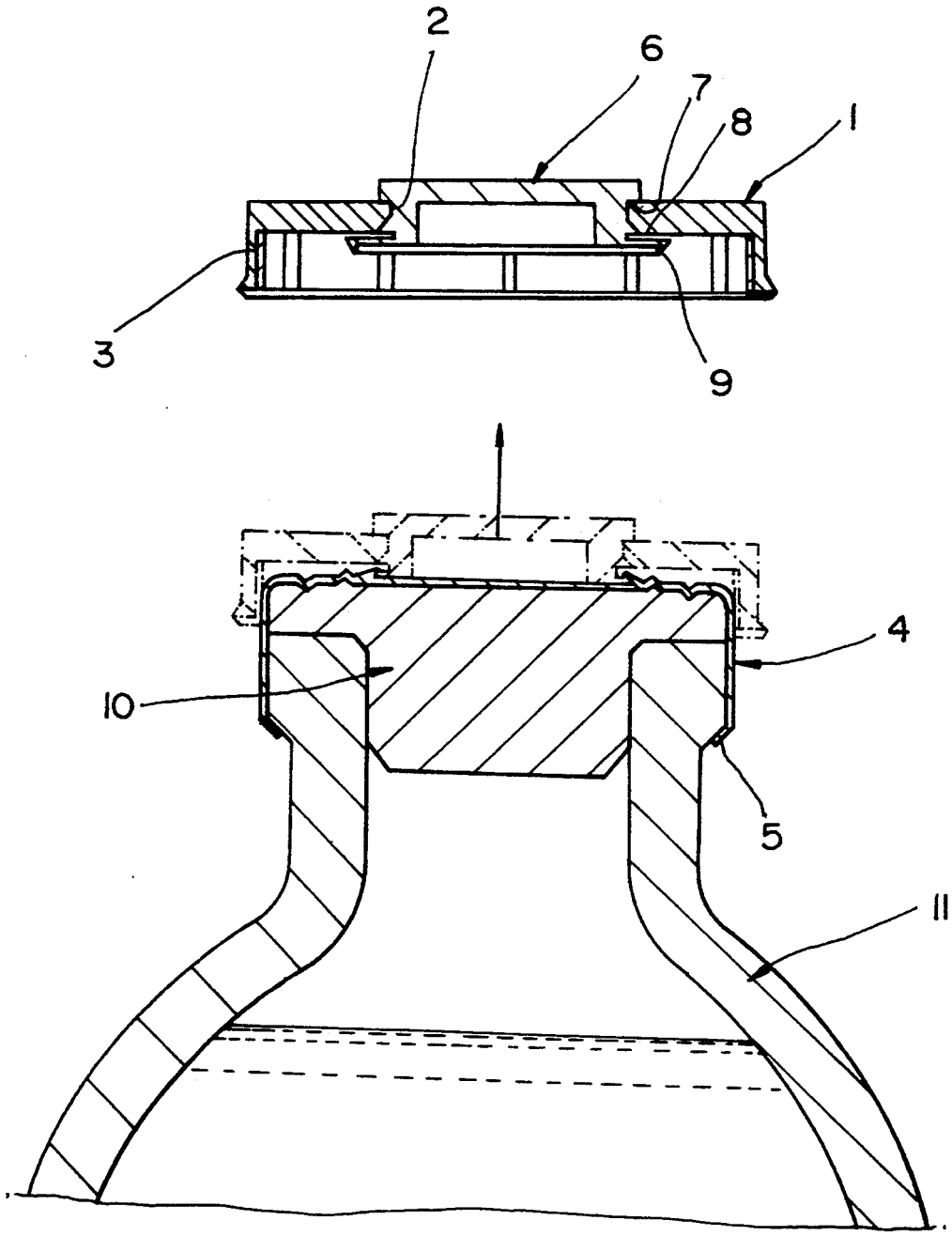
FIG. 3 is a sectional view showing the sealing cap of the present invention separated from the injectable fluid bottle.

With reference to FIGS. 1 to 3, there is shown a stopper sealing cap for an injectable fluid bottle in accordance with a primary embodiment of the present invention. The sealing cap includes an aluminum cap member 4 which lightly covers the upper section of the bottle 11 including a flanged mouth and a neck of the bottle 11. This aluminum cap member 4 is in turn covered with a synthetic resin cap member 1 and provided with a circular center opening 4" at its upper top. In the same manner, the synthetic resin cap member 1 is formed with at circular insert opening 2 at the center of its upper top. This synthetic resin cap member 1 also has a plurality of vertical slots 3 at the inner surface of its side wall. The sealing cap of this invention further includes means for sealing the upper surface of a rubber stopper 10 placed in the neck of the bottle 11 and for preventing the upper surface from contamination. In this primary embodiment, the sealing means comprises a sealing member 6 which engages with the synthetic resin:cap member 1. This sealing member 6 is received in the insert opening 2 of the synthetic resin cap member 1 such that its upper top having a circular flange 7 protrudes out of the upper surface of the cap 1. This sealing member 6 is also provided with a radial annular groove 8 at its lower section. An annular protrusion 9 downwardly extends from the periphery or the bottom surface of the sealing member 6.

In assembly of the above members 1, 4 and 6 into the sealing cap, the aluminum cap member 4 is brought into engagement with the sealing member 6 at first, thereby providing a pre-assembly of the sealing cap. In order to bring the aluminum cap member 4 into engagement with the sealing member 6, the sealing member 6 is inserted into the opening 4'' of the aluminum cap member 4 such that the radial annular groove 8 of the sealing member 6 receives the periphery 4' of the opening 4'' of the cap ember 4 as shown in FIG. 2A. The engagement of the aluminum cap member 4 with the sealing member 6 for providing the pre-assembly is followed by a second engagement for providing a result assembly of the sealing cap. This second engagement is achieved by inserting the sealing member 6 of the pre-assembly of FIG. 2A into the synthetic resin cap member 1 such that the flanged upper top of the member 6 protrudes out of the upper surface of the resin cap member 1 as shown in FIG. 2B. At this state, the inner periphery 2' of the resin cap member 1 is tightly caught by the upper flange 7 of the sealing member 6.

Thereafter, the result assembly of the sealing cap, in which the sealing member 6 engages with both the aluminum cap member 4 and the synthetic resin cap member 1, is washed under pressure and taken into custody while being hermetically encased in a disinfected synthetic resin envelope to prevent infiltration of contaminants. In practical use of this sealing cap with the injectable fluid bottle 11, the disinfected sealing cap is pressed down onto the flanged mouth of The bottle 11, which is plugged with the rubber stopper 10 and contains an injectable fluid. The lower end 5 of a skirt section of the aluminum cap member 4 thus comes into tight contact with the outer surface of the neck of the bottle 11. As a result, the lower surface or the sealing member 6 closely contacts with the upper surface of the rubber stopper 10 and the annular protrusion 9 of the sealing member 6 cuts into the upper surface of the rubber stopper 10 as shown in 2C. The circular section of the rubber stopper 10 inside the annular protrusion 9 of the sealing member 6 is isolated from the outside, so that this circular section is protected from contaminant infiltration. The bottle 11 combined with the sealing cap of this invention is in turn subjected to a sterilization in a sterilizer at a temperature of 121° C. for 25 to 30 minutes. The upper surface of the rubber stopper 10 is thus completely sterilized and, in particular the circular section of the stopper 10 inside the annular protrusion 9 of the sealing member 6 maintains the sterilized state until the sealing member 6 is removed from the bottle 11. The sterilization of the bottle 11 causes steam to infiltrate between the cap member 1 and 4; however, this steam is exhausted therefrom through the plurality of vertical slots 3 of the synthetic resin cap ember 1, so that there is no problem caused by the steam.

Exposure of the upper surface of the rubber stopper 10 is simply achieved by levering the synthetic resin cap ember 1 while gripping the said wall of this cap member 1. At this time, since the inner periphery 2' of the synthetic resin cap member 1 is caught by the circular flange 7 of the sealing member 6, the levering force acting on the cap member 1 causes the inner periphery 4' of the aluminum cap ember 4 to be released from the annular groove 8 of sealing member 6 prior to separation or both the synthetic resin cap member 1 and the sealing member 6 from the bottle 11 as shown in FIG. 3. After removal of both the synthetic resin cap member 1 and the sealing member 6, the exposed upper surface of the rubber stopper 10, still annularly covered by the aluminum cap member 4, is subjected to disinfection using an alcoholic cotton and penetrated by a needle of a syringe or of Ringer's set.

Figure 4:
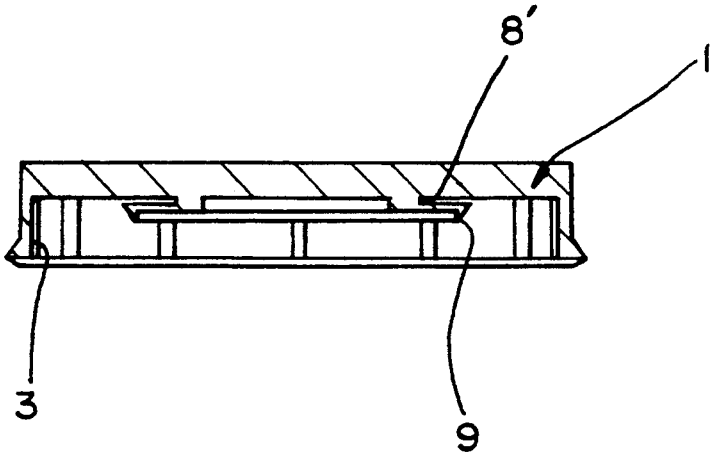
FIG. 4 is a sectional view of a sealing cap in accordance with another embodiment of the present invention.

Turning to FIG. 4, there is shown a sealing cap in accordance with another embodiment of the present invention. In this embodiment, the general shape of the sealing cap remains the same as in the primary embodiment, but the sealing means having the annular protrusion 9 is integrally formed with the bottom surface of the synthetic resin cap member 1 in such a manner that an annular gap 8' is provided between the bottom surface of the cap member 1 and the sealing means for receiving the periphery 4' of the aluminum cap member 4. This embodiment yields the same result as that described for the primary embodiment without affecting the functioning of this invention, and further explanation is thus not deemed necessary.

As described above, the stopper seating cap for an injectable fluid bottle of the present invention includes a means for sealing the upper surface of the rubber stopper placed in the neck of the bottle. This sealing means engages with an aluminum cap member covering the upper section of the bottle. The sealing cap further includes a synthetic resin cap member covering the aluminum cap member and supporting the sealing means. When the cap embers are assembled with the sealing means into the sealing cap, the sealing cap is subjected to disinfection and used with the bottle of which the neck is plugged with the rubber stopper. When this sealing cap is used with the injection fluid bottle, the upper surface of the rubber stopper placed in the bottle neck is isolated from the outside by the sealing means and completely protected from contamination. Thus, the sealing cap suitable for prevention of contamination of the rubber stopper allows no contaminant to infiltrate into human body through a needle penetrating the rubber stopper.

Although the preferred embodiments of the present invention have been disclosed for illustrative purposes, those skilled in the art will appreciate that various modification, additions and substitutions are possible, without departing from the scope of spirit or the invention as disclosed in the accompanying claims,

What is claimed is:

1. A stopper sealing cap for an injectable fluid bottle comprising:

a means for sealing an upper surface of a stopper of said bottle to prevent contaminant infiltration onto said upper surface of said stopper, said means having an annular protrusion for annularly cutting into said upper surface of said stopper to seal a circular section of said upper surface of said stopper;

an aluminum cap member engaging with said sealing means for covering an upper section of said bottle, said aluminum cap member having a center opening for receiving said sailing means to engage with said sealing means; and a synthetic resin cap member having a top wall with an upper surface and a lower surface and a side wall covering said aluminum cap member and supporting said sealing means, said resin cap member being removed together with said sealing means from said bottle and having a plurality of vertical slots on an inner surface of said side wall for providing exhausting spaces between said side wall and said aluminum cap member.

2. The stopper sealing cap according to claim 1, wherein said synthetic resin cap member is provided with a center insert opening in said top wall, and said sealing means comprises a sealing member having a flanged upper top and a lower annular groove, said flanged upper top being received in said center insert opening of said resin cap member to protrude out of said upper surface of said resin cap member and to be caught by a periphery of said center insert opening, and said lower annular groove receiving s periphery of said center opening of said aluminum cap member.

3. The stopper sealing cap according to claim 1, wherein said sealing means is integrally formed with said lower surface of said synthetic resin cap member such that an annular gap is provided between said lower surface and said sealing means.

* * * * *